US006796779B1

(12) United States Patent
Chang et al.

(10) Patent No.: US 6,796,779 B1
(45) Date of Patent: Sep. 28, 2004

(54) SCROLL COMPRESSOR RING HAVING A LUBRICANT GAP

(75) Inventors: Lung-Tsai Chang, Taoyuan Hsien (TW); Guang-Der Tarng, Taoyuan Hsien (TW)

(73) Assignee: Rechi Precision Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/418,199

(22) Filed: Apr. 18, 2003

(51) Int. Cl.[7] ..... F04C 18/04; F04C 29/02
(52) U.S. Cl. ..... 418/55.6; 418/94
(58) Field of Search ..... 418/55.6, 94

(56) References Cited

U.S. PATENT DOCUMENTS 5,197,868 A * 3/1993 Caillat et al. ..... 418/55.6
5,716,202 A * 2/1998 Koyama et al. ..... 418/55.6

FOREIGN PATENT DOCUMENTS

JP 4-191489 * 7/1992 ..... 418/55.6

* cited by examiner

*Primary Examiner*—John J. Vrablik
(74) *Attorney, Agent, or Firm*—Troxell Law Office PLLC

(57) ABSTRACT

An improvement of a ring for a scroll compressor by forming a gap at an angle on the top of the ring where is less subject to pressure, and an askew tangent plane descending outwardly from the bottom of the gap to allow the lubricant passing through the gap and flowing along the askew plane into the spacing between the ring and the circulating scroll to maintain consistent lubrication among the ring, the eccentric rod and the circulating scroll when the ring floats up to the top to hold against the body of the circulating scroll.

2 Claims, 5 Drawing Sheets

SCROLL COMPRESSOR RING HAVING A LUBRICANT GAP

BACKGROUND OF THE INVENTION (a) Field of the Invention

The present invention is related to a scroll compressor ring, and more particularly, to one that provided with a gap to allow lubricant to pass through the gap and flow along an askew tangent plane at the bottom of the gap to enter into the spacing between the ring and the circulating scroll for maintaining consistent lubrication among the ring, the eccentric rod and the circulating scroll when the ring floats up to the top to compress against the body of the circulating scroll.

(b) Description of the Prior Art

Whereas, the working principal of a scroll compressor essentially involves the revolution executed by a circulating scroll driven by a driver inside a fixed scroll without revolving on its own axis to change the volume between the fixed scroll and the circulating scroll thus to compress the coolant at low temperature and low pressure into the status of high temperature and high pressure, the coolant is release through the outlet into the coolant pipe of the system to execute heat exchange with the compressor in cycle.

Since the circulating scroll revolves inside the fixed scroll without revolving on its own axis, the structure of the compressor as illustrated in FIG. 1 is essentially comprised of an eccentric rod (A1) to hold the circulating scroll (A2) in position for the circulating scroll (A2) revolves in surrounding the fixed scroll (A3), and a ring (A4) is inserted to the core of the circulating scroll (A2) and the eccentric rod (A1) is inserted into the center of the ring (A4) for the circulating scroll (A2) to couple to the eccentric rod (A1) for fixing the circulating scroll (A2) in position.

Furthermore, to lubricate the eccentric rod (A1), ring (A4) and the circulating scroll (A2), a filler (A11) is provided to penetrate the eccentric rod (A1) so that while the compressor is operation, the lubricant flows at out of the filler (A11) at where in relation to the end of the eccentric rod (A1) to lubricate among the eccentric rod (A1), the ring (A4) and the circulating scroll (A2) However, when the compressor is operation, the ring (A4) usually floats up to the top to hold against the body of the circulating scroll (A2) to stop the lubricant from flowing over the ring (A4) to block up the lubricant passage.

SUMMARY OF THE INVENTION

The primary purpose of the present invention is to provide an improvement of a ring for a scroll compressor that maintains normal lubrication among the rod, the ring and the circulating scroll. To achieve the purpose, a gap is formed at an angle on the ring where is less subject to pressure on the top of the ring, and an askew tangent plane descending outwardly at the bottom of the gap so that when the ring floats up to hold against the body of the circulating scroll at the top, the lubricant passes through the gap and flows along the askew tangent plane at the bottom of the gap to enter into the spacing between the ring and the circulating scroll for maintaining consistent lubrication among the ring, the eccentric rod and the circulating scroll when the ring floats up to the top to compress against the body of the circulating scroll.

Another purpose yet of the present invention is to provide an improvement of a ring for a scroll compressor; wherein, the askew tangent plane on the ring can be forthwith extended from the outer circumference of the ring into the inner circumference on the top of the ring, and a gap is cut on the top of the ring to allow the lubricant to flow through without affecting the structural strength of the entire ring.

DETAILED DESCRIPTION OF THE PREFERRED EMBODIMENTS

Figure 1:
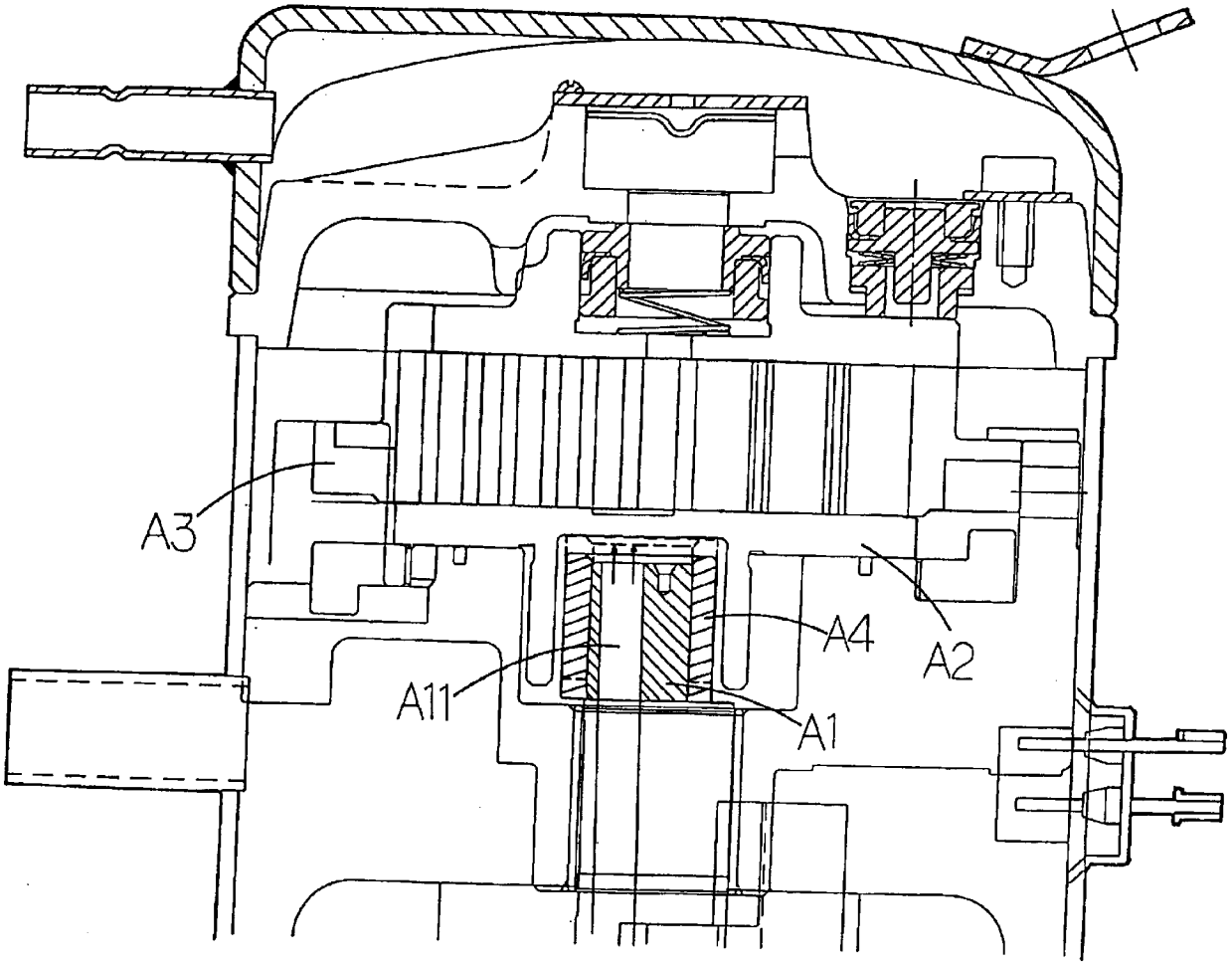
FIG.1 Prior Art
FIG. 1 is a schematic view showing an layout of a circulating scroll and an eccentric rod of a compressor of the prior art.
Figure 2:
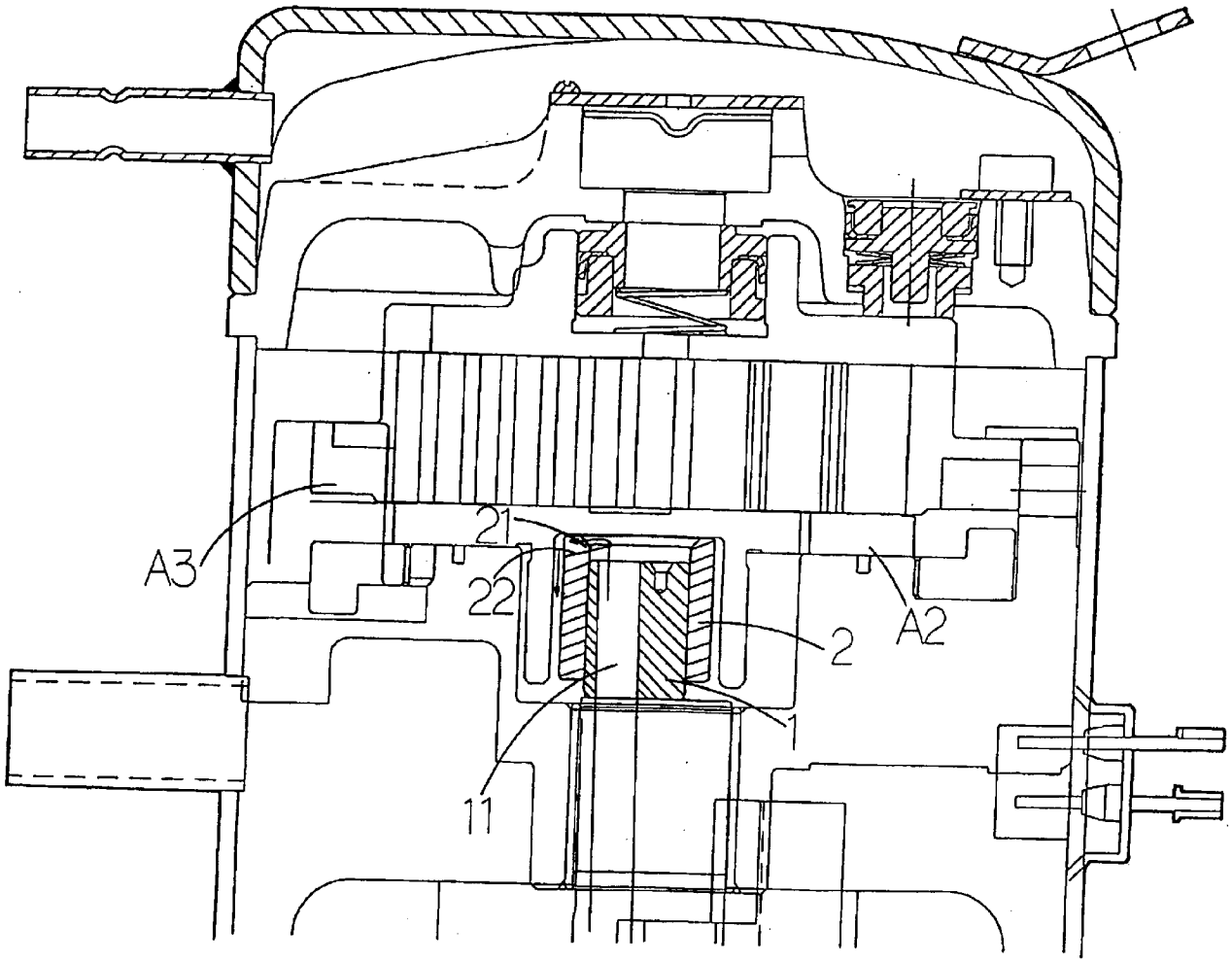
FIG. 2 is a schematic view showing the operation status of a ring, a circulating scroll and an eccentric rod of a preferred embodiment of the present invention.
Figure 3:
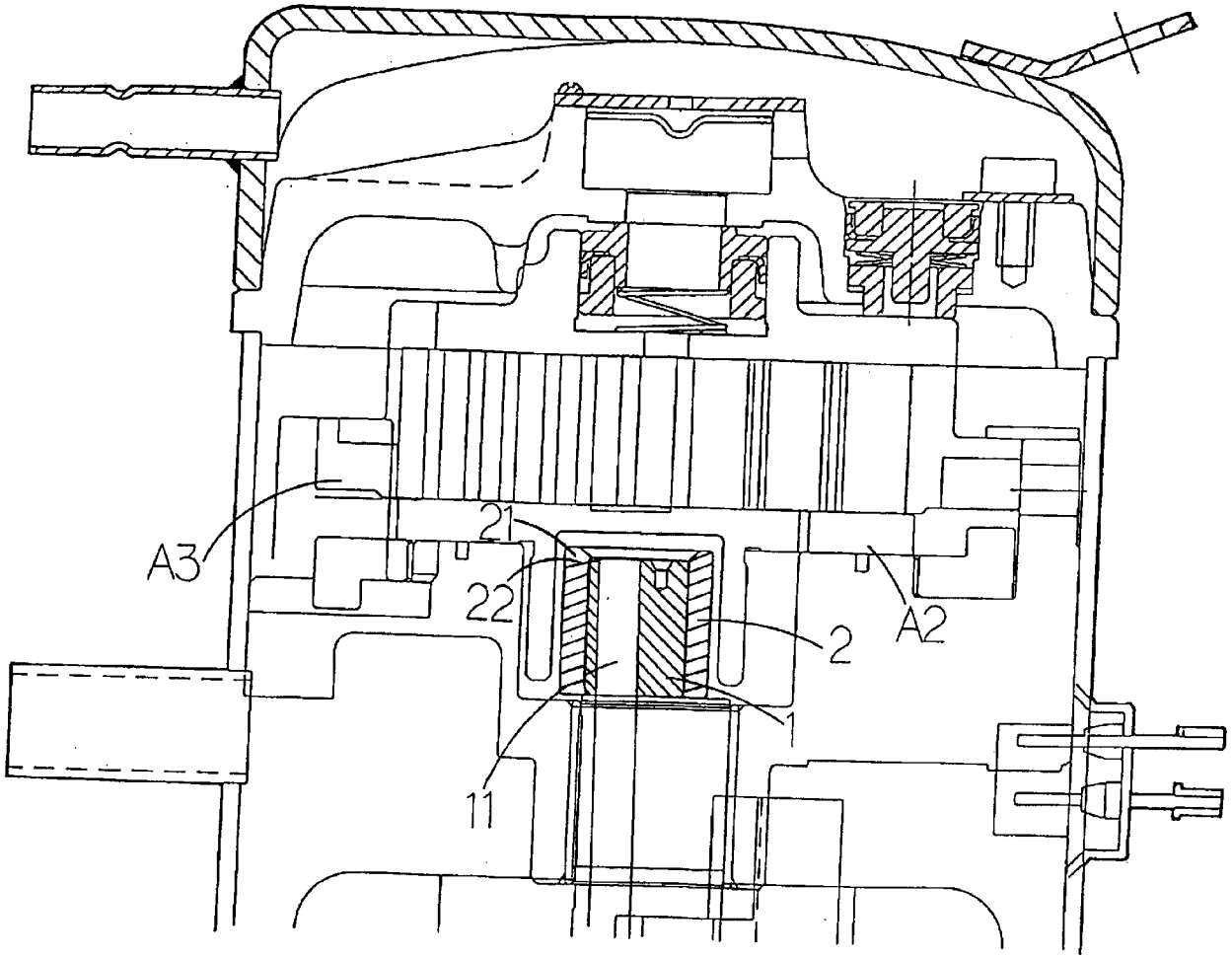
FIG. 3 is a schematic view showing a layout of the ring, the circulating scroll and the eccentric rod of the preferred embodiment of the present invention.
Figure 4:
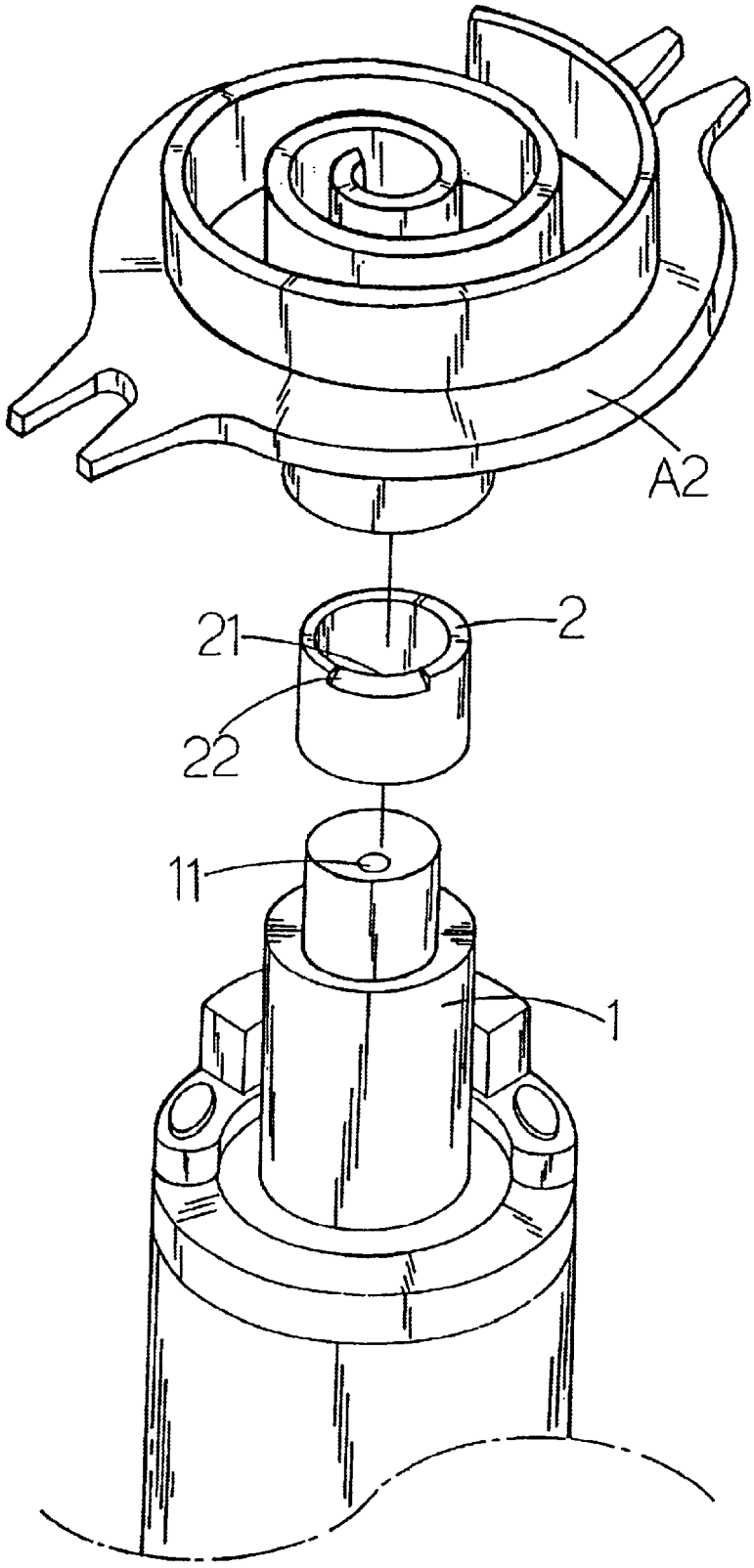
FIG. 4 is a schematic view showing a structural breakdown of the ring, the circulating scroll and the eccentric rod of the preferred embodiment of the present invention.

Referring to FIGS. 2, 3, and 4, an improved structure of a ring in a scroll compressor of the present invention is essentially having a ring (2) provided at the core of a circulating scroll (A2) to incorporate the circulating scroll (A2) and an eccentric rod (1); wherein, a filler (11) penetrates through the body of the eccentric rod (1) so that when the compressor is operating, lubricant passes through the filler (11) at where in relation to the end of the eccentric rod (1) to lubricate among the eccentric rod (1), the ring (2) and the circulating scroll (A2).

A gap (21) is formed at an angle where is less subject to the pressure on the top of the ring (2), an askew tangent plane (22) descending outwardly is provided at the bottom of the gap (21). Consequently, when the ring (2) floats up to the top to hold against the body of the circulating scroll (A2), the lubricant flows out of the gap (21), then along the askew tangent plane (22) into a spacing between the ring (2) and the circulating scroll (A2) to maintain consistent lubrication among the eccentric rod (1), the ring (2) and the circulating scroll (A2).

Figure 5:
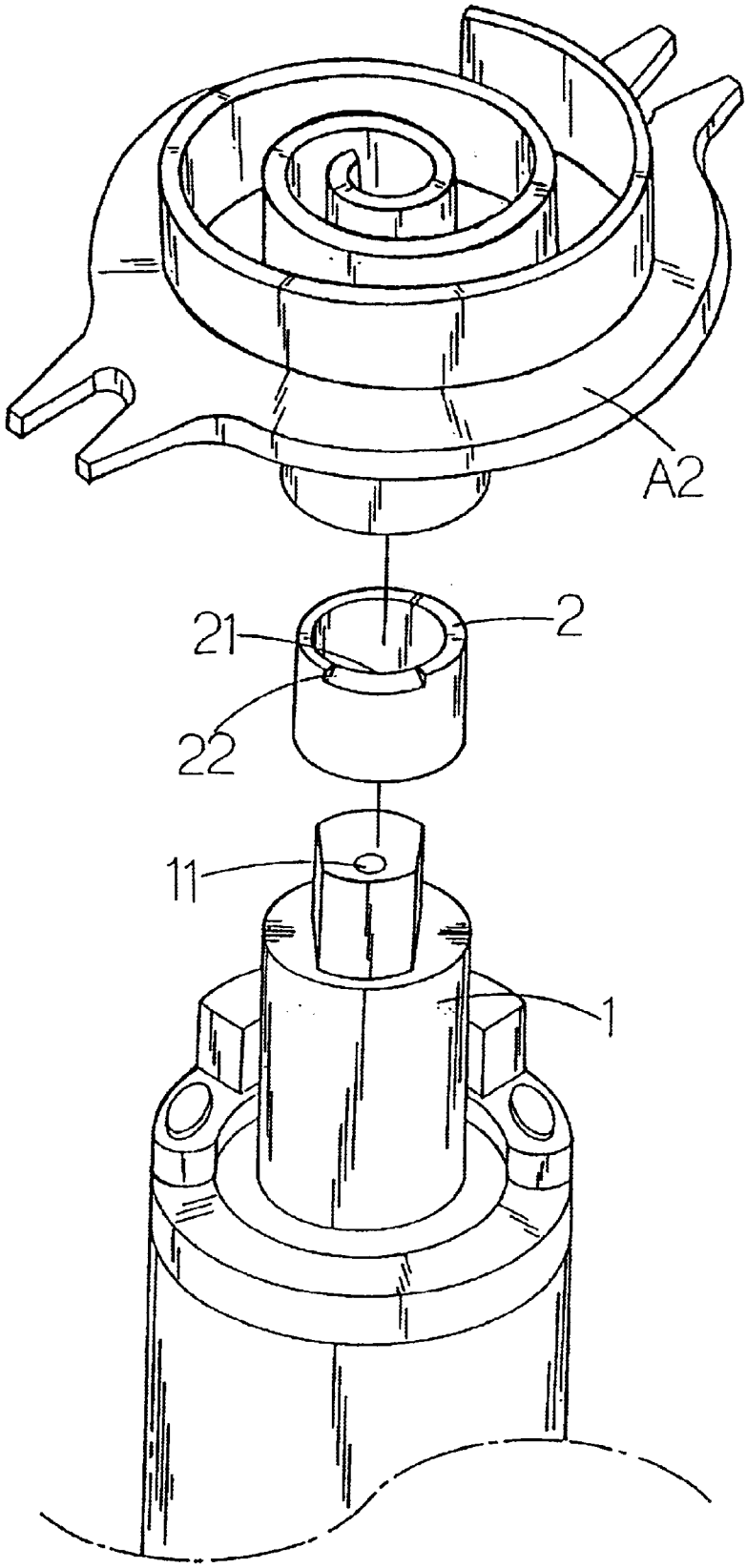
FIG. 5 is a schematic view showing another structural breakdown of the ring, the circulating scroll and the eccentric rod of the preferred embodiment of the present invention.

As illustrated in FIGS. 3, 4, and 5, the askew tangent plane (22) on the ring (2) directly extends from the outer circumference of the ring (2) to the inner circumference of the top of the ring (2) to form the gap (21) on the top of the ring (2) for the lubricant to flow out of the gap (21), and the presence of the gap (21) will not affect the structure strength of the ring (2) as a whole.

The present invention by forming a gap at an angle on the top of the ring where is less subject to pressure, and an askew tangent plane descending outwardly from the bottom of the gap to allow the lubricant passing through the gap and flowing along the askew plane into the spacing between the ring and the circulating scroll to maintain consistent lubrication among the ring, the eccentric rod and the circulating scroll when the ring floats up to the top to hold against the body of the circulating scroll; and furthermore, the askew tangent plane being directly extended from the outer circumference of the ring to the inner circumference on the top of the ring to form the gap for allowing the lubricant to follow through without affecting the structural strength of the ring as a whole, provides an improved structure of the ring for the scroll compressor; this application for utility patent is duly filed accordingly.

We claim:

1. A scroll compressor ring to distribute lubricant to a circulating scroll and an eccentric rod comprising:

a) a cylindrical ring located on the eccentric rod adjacent to the circulating scroll and having:

i) an askew plane surface located on a top of the ring and descending outwardly toward a bottom of the ring in a direction moving from an inner periphery of the ring to an outer periphery of the ring; and ii) a lubricant gap formed on the top of the ring and extending from an inner periphery of the ring to an outer periphery of the ring, the askew plane surface defining a bottom of the lubricant gap, such that, when the ring is pressed against the circulating scroll during operation, lubricant flows through the lubricant gap and between the ring and the circulating scroll to lubricate the eccentric rod.

2. The scroll compressor ring according to claim 1, wherein the inner and outer peripheries of the ring adjacent to the askew plane surface are curved.

* * * * *